US006253694B1

(12) United States Patent
Mitsuji

(10) Patent No.: US 6,253,694 B1
(45) Date of Patent: Jul. 3, 2001

(54) SEWING MACHINE WITH TRIMMING KNIVES

(75) Inventor: Toshiro Mitsuji, Toyonaka (JP)

(73) Assignee: Yamato Mishin Seizo Kabushiki Kaisha, Osaka (JP)

( * ) Notice: Subject to any disclaimer, the term of this patent is extended or adjusted under 35 U.S.C. 154(b) by 0 days.

(21) Appl. No.: 09/563,296

(22) Filed: May 3, 2000

(30) Foreign Application Priority Data

Jun. 4, 1999 (JP) ..... 11-158764

(51) Int. Cl.[7] ..... D05B 37/06
(52) U.S. Cl. ..... 112/122
(58) Field of Search ..... 112/130, 122, 112/129, 122.1, 125, 284, 220; 83/936, 938

(56) References Cited

U.S. PATENT DOCUMENTS 4,517,908 * 5/1985 Park ..... 112/129
4,773,342 * 9/1988 Fietta ..... 112/129
5,289,789 * 3/1994 Sakuma ..... 112/122
6,101,960 * 8/2000 Ebata et al. ..... 112/122

FOREIGN PATENT DOCUMENTS 61-24226 7/1986 (JP) .
10287 1/1998 (JP) .

* cited by examiner

*Primary Examiner*—Ismael Izaguirre
(74) *Attorney, Agent, or Firm*—Birch, Stewart, Kolasch & Birch, LLP

(57) ABSTRACT

An operational knife is attached at one end of a knife shaft and repeatedly projects from the front portion of a needle plate, thereby it trims a fabric with a stationary knife. A transmitting lever is loosely fit on the knife shaft halfway in the shaft direction. A transmitting ring is fit close to the transmitting lever so as to be movable in the axial direction. Components of a clutch are respectively formed on both opposing faces of the transmitting ring and transmitting lever so that the clutch is engaged/disengaged as the transmitting ring touches or separate from the transmitting lever. The transmitting lever is connected via a link member to a oscillating shaft which oscillates on its axis driven by a rotating machine spindle. The oscillation is transmitted to the knife shaft via the transmitting ring thereby operates the operational knife only when the clutch is engaged. The projecting motion of the operational knife which is to trim an edge hem of a folded fabric before the fabric is fed onto needle drop points can be activate or deactivate with a simple trimming knife mechanism.

7 Claims, 5 Drawing Sheets

SEWING MACHINE WITH TRIMMING KNIVES

BACKGROUND OF THE INVENTION

The present invention relates to a sewing machine with trimming knives, in which an operational knife having a hook-shaped tip is repeatedly projected from a needle plate and comes into slidably contact with a stationary knife disposed at a corresponding position to thereby cut an edge hem of a fabric being fed to needle drop points in a state where the edge hem is folded to the back side for a predetermined width.

For example, when a tube portion for inserting an elastic tape is formed around the waist portion of sweatpants, trousers for an infant, and the like, the edge hem of a target fabric is folded to the back side for a predetermined width, and in such a state, the fabric is fed to needle drop points and hemmed to the surface side of the fabric.

In order to perform the hemming with high efficiency, a sewing machine with trimming knives is used. In the sewing machine, an operational knife having a hook-shaped tip is disposed on one side of the front portion of a needle plate and is moved up-and-down so as to repeatedly project from the needle plate as it is driven by the machine spindle to thereby slidably come into contact with a stationary knife disposed in a corresponding position. The edge hem of the fabric fed to the needle drop points is captured by the tip of the operational knife, the operational knife trims the fabric with the stationary knife while letting a predetermined folding width remain and the resultant fabric feed to the needle drop points.

A sewing machine with trimming knives of this kind, however, has an inconvenience such that the projecting operation of the operational knife in the front position of the needle plate disturbs the feeding of the fabric during regular sewing which is not including the hemming. In order to solve the inconvenience, for example, Japanese Unexamined Patent Application No. 10-287 discloses a sewing machine with trimming knives in which a portion for connecting/disconnecting the transmitting power is provided halfway in a transmitting system between the machine spindle and the operational knife, and the up-and-down movement of the operational knife is stopped by cutting the power transmission to the operational knife.

In the power transmission system to the operational knife, the proximal portion of the operational knife is attached to the knife shaft rotatably attached over a sewing bed so that the tip of the operational knife is moved up-and-down by the oscillation of the knife shaft on it axis. The knife shaft is connected via a link member and a transmitting lever to a oscillating shaft which is in parallel to the knife shaft, the oscillating shaft is connected to the machine spindle via a known eccentric mechanism, and the oscillation of the oscillating shaft according to the rotation of the machine spindle is transmitted to the knife shaft via the link member and the transmitting lever, thereby oscillating the knife shaft.

The connecting/disconnecting portion disclosed in Japanese Unexamined Patent Application No. 10-287 has a construction such the transmitting lever for connecting the knife shaft is divided into two parts in the longitudinal direction, and the two parts are connected/disconnected by insertion/extraction of a coupling pin attached to an output end of an air cylinder. When the coupling pin is inserted, the operational knife is moved up-and-down by the power transmitted from the integrated transmitting lever. When the coupling pin is extracted, the vertical movement of the operational knife is stopped due to the disconnection of the parts of the transmitting lever.

In the connecting/disconnecting portion, the disconnection of the parts of the transmitting lever is realized by a coupling portion which is bent by an upward movement of the operational knife. The connecting/disconnecting portion is constructed so that the power transmission at the time of extraction of the coupling pin is interrupted after the transmitting lever swings in the direction opposite to the bending direction, that is, after the operational knife is moved to the lowermost position where the operational knife gets away below the needle plate, thereby preventing the operational knife from disturbing the feeding of fabric to the needle drop points.

In the connecting/disconnecting portion disclosed in the publication 10-287, a special transmitting lever having a bendable portion in the middle is used. This kind of the transmitting lever has problems with complicated mechanisms and difficulty of construction strong enough to sustain with high-speed sewing. Further, the prior art also has a problem with difficulty of assembling an air cylinder for connecting/disconnecting the coupling pin near an inherent disposing space of the transmitting system below the needle plate.

Japanese Examined Utility Model Publication No. 61-24226 and the like disclose a sewing machine with trimming knives having a stroke adjusting mechanism capable of adjusting a vertical stroke of the operational knife including a zero stroke. According to the sewing machine, when performing a sewing other than hemming, by adjusting the vertical stroke to zero, the projection of the operational knife can be prevented without disturbing the feeding of fabric.

The stroke adjusting mechanism of this kind is, however, relatively large in size because it is constructed by combining a plurality of link mechanisms and thus it requires many components.

SUMMARY OF THE INVENTION

The present invention has been achieved to solve the above problems and an object of the invention is to provide a sewing machine with trimming knives in which projecting of an operational knife for trimming a folded edge hem of a fabric before the fabric reaches needle drop points can be controlled with a simple mechanism and the operational knife can be easily installed in the proximity of disposing space of a transmitting mechanism.

A sewing machine with trimming knives of the first aspect according to the present invention comprises: a knife shaft which is rotatably provided over a knife table attached to a sewing bed and having one end to which an operational knife is attached; a transmitting lever whose one end is loosely fit on the knife shaft half way in the shaft direction and whose other end is connected via a link member to a oscillating shaft which oscillates on its axis driven by a machine spindle; a transmitting ring which is fit on the knife shaft so as to be movable in the shaft direction and is fixed in an appropriate position in the direction; a clutch whose components are formed on the opposing faces of both the transmitting ring and transmitting lever and which is engaged or disengaged according to the transmitting ring approaching to or separating from the transmitting lever; and a stationary knife which slidably contacts with one side of the operational knife which swings up-and-down according to the oscillation of the knife shaft, when the clutch is engaged, thereby cutting an edge hem of a fabric being fed onto the sewing bed.

In the invention, the components of the clutch are formed on the opposing faces of both the transmitting ring and transmitting lever. The transmitting ring is fit on the knife shaft to which the operational knife is attached, so as to be movable in the axial direction. The transmitting lever is loosely fit on the knife shaft at one end. When the transmitting ring is positioned close to the transmitting lever to thereby engage the clutch, the oscillating movement transmitted from the machine spindle to the transmitting lever via the oscillating shaft and link member is transmitted to the knife shaft via the clutch and transmitting ring. Consequently, the operational knife attached to the knife shaft moves up-and-down. On the contrary, when the transmitting ring is positioned apart from the transmitting lever to thereby disengage the clutch, the oscillating movement transmitted from the machine spindle to the transmitting lever via the oscillating shaft and link member is not transmitted to the knife shaft on which the transmitting lever is loosely fit. Consequently, the operational knife does not move at all.

The sewing machine with trimming knives of the second aspect according to the invention is characterized in that the clutch is a claw clutch which achieves its engagement state by engaging a concave portion formed on either one of the transmitting ring or transmitting lever and a convex portion formed on the other.

In the invention, the clutch whose components are formed on the opposing faces of both the transmitting ring and transmitting lever is simply constructed as a claw clutch having a concave portion formed on one of the components and a convex portion formed on the other component. The claw clutch is achieved its engagement by engaging the both components.

The sewing machine with trimming knives of the third aspect according to the invention is characterized by comprising a first energizing member which is interposed between the transmitting ring and transmitting lever, and energizes the transmitting ring and transmitting lever in the separating direction from each other.

In the invention, the first energizing member for energizing the transmitting ring and transmitting lever so as to be apart from each other is interposed between the transmitting ring and transmitting lever. When the transmitting ring is loosened, the transmitting ring is moved away by the energizing force of the first energizing member to thereby certainly realize the disengagement of the clutch. The first energizing member can be realized by, for example, interposing a coil spring which is loosely held by the knife shaft in a contracted state between the transmitting ring and transmitting lever.

Further, the sewing machine with trimming knives of the fourth aspect according to the invention is characterized by comprising a second energizing member which is interposed between the transmitting ring and knife table, and energizes so as to rotate the transmitting ring on its axis to restrict the operational knife at a downward movement position via the transmitting ring and knife shaft, when the clutch is disengaged.

In the invention, the second energizing member is interposed between the transmitting ring fit on the knife shaft and the knife table as a supporting table of the knife shaft. By the action of the second energizing member, when the clutch is disengaged, the transmitting ring is energized in the circumferential direction to lower the operational knife attached to the knife shaft to the downward movement position and is restricted so that the operational knife does not happened to be moved upward by an external effect such as a friction force acting on the loose-fit portion of the transmitting lever, a vibration during a sewing operation, or the like, and does not project from the needle plate. The second energizing member can be realized by, for example, making both ends of a helical spring attached to the knife shaft fit in the transmitting ring and the knife table.

The above and further objects and features of the invention will more fully be apparent from the following detailed description with accompanying drawings.

DETAILED DESCRIPTION OF THE INVENTION

Embodiments of the invention will be described in detail hereinbelow with reference to the drawings.

Figure 1:
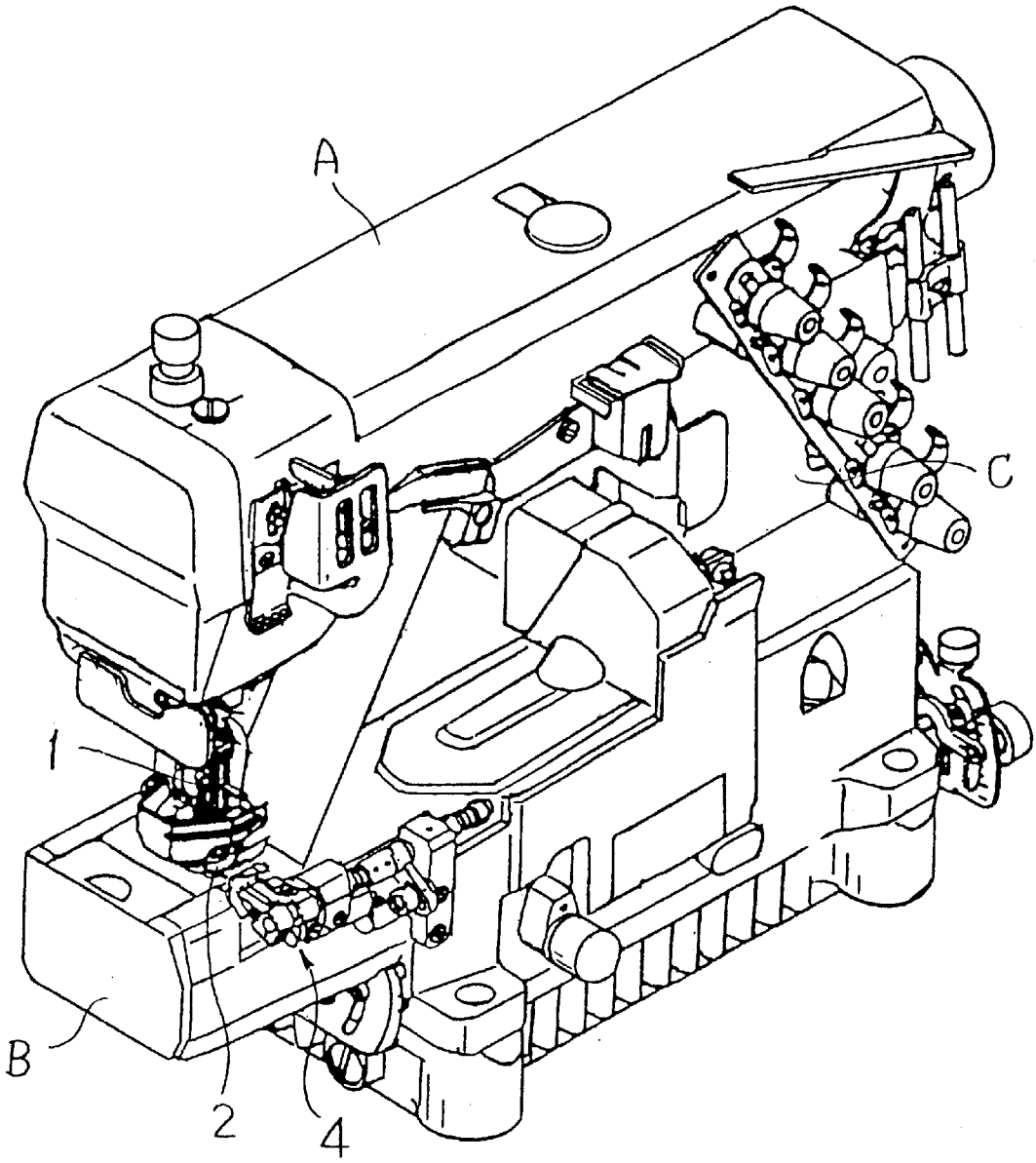
FIG. 1 is a perspective view showing the overall configuration of a sewing machine with trimming knives according to the present invention.

FIG. 1 is a perspective view showing the overall configuration of a sewing machine with trimming knives according to the present invention. The sewing machine in the figure is shown as a covering-chain-stitch machine in which a plurality of needles 1 are attached to the lower end of a sewing head suspended from the free end of a sewing arm A of which proximal end is supported by a leg section C provided upright on a sewing bed B, a presser plate 2 is attached similarly to the lower end of a presser foot, and a looper and a feeding mechanism (they are not shown) are provided below a needle plate 3 (refer to FIG. 2) attached horizontally and rotatably over the front section of the sewing bed B which faces the needles 1 from below.

The needles 1 oscillate vertically with a predetermined stroke through the needle plate 3 together with the presser foot by a power transmitted from an upper shaft (not shown) installed in the sewing arm A. The presser plate 2 is lowered onto the needle plate 3 by a predetermined operation to press a fabric W (refer to FIG. 4) between the presser plate 2 and needle plate 3 where the fabric W is fed from the front onto the sewing bed B with the needle plate 3. The pressed fabric W is sewn by the vertical oscillation of the needles 1 while being fed, and motion of the looper and feeding mechanism which is performed below the needle plate 3 synchronously with the vertical oscillation of the needles 1.

Figure 2:
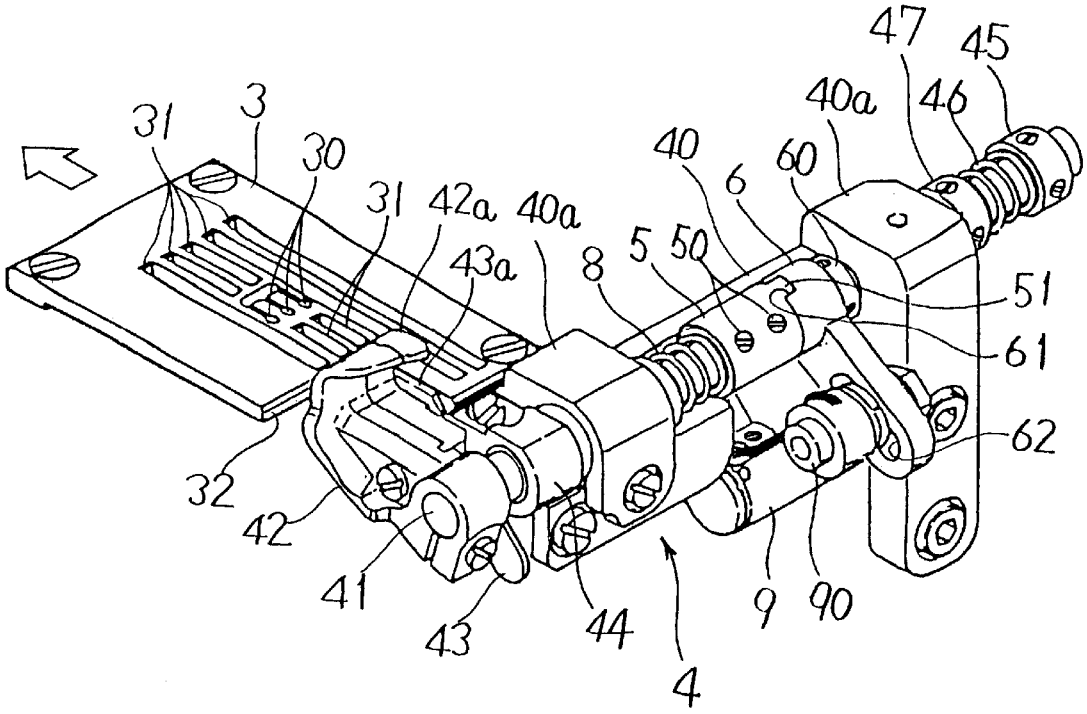
FIG. 2 is a perspective view showing the configuration of a trimming mechanism provided to the sewing machine with trimming knives according to the present invention together with a needle plate.
Figure 3:
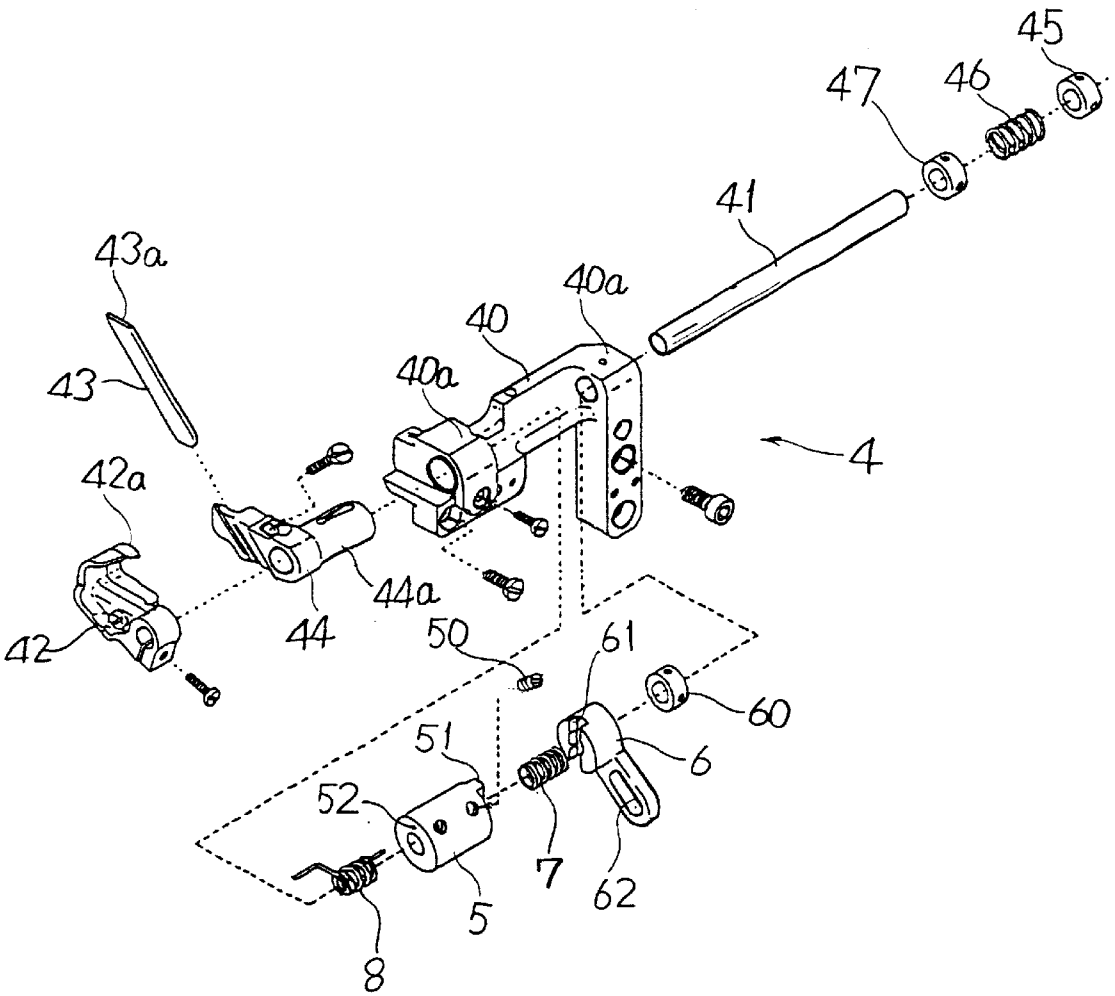
FIG. 3 is an exploded perspective view of the trimming mechanism provided to the sewing machine with trimming knives according to the present invention.

As shown in FIG. 1, the covering-chain-stitch machine configured as mentioned above has a trimming mechanism 4 on the front section of the sewing bed B. FIG. 2 is a perspective view showing the configuration of the trimming mechanism 4 together with the needle plate. FIG. 3 is an exploded perspective view of the trimming mechanism 4.

In FIG. 2, reference numeral 3 denotes the needle plate hung across the upper surface of the left end portion of the sewing bed B as described above. In the needle plate 3, in an almost center area, a plurality (three of them are shown in the figure) of needle-drop holes 30 through which the plurality of vertically oscillating needles 1 are inserted when the needles 1 move downward are provided along the width direction. On both sides in the longitudinal and width directions around the needle-drop holes 30, rectangular feeding holes 31 for allowing feeding teeth (not shown) to project are provided.

On the needle plate 3, as shown by the blank arrow in FIG. 2, the fabric W is fed from one side to the other in the longitudinal direction while the fabric W is pressed between the needle plate 3 and downed presser plate 2 (refer to FIG. 1). By the oscillating motion of feeding teeth (not shown) which project through the feeding holes 31, the fabric W is intermittently fed with a predetermined stroke and is sewn by the needles 1 and loopers (not shown). Here, the needles 1 fall into the respective needle-drop holes 30 and the loopers (not shown) are disposed in the corresponding positions below the needle plate 3.

The trimming mechanism 4 has: a knife table 40 fixedly provided in the front section of the needle plate 3; a knife shaft 41 rotatably installed over the knife table 40; an operational knife 42 whose proximal end is fit to one end of the knife shaft 41; and a stationary knife 43 which slidably contacts with one end (right side in the figure) of the operational knife 42. The operational knife 42 is driven by the machine spindle (not shown) so as to be slidably in contact with the stationary knife 43, thereby trimming the edge hem of fabric W being fed onto the needle plate 3.

The knife table 40 is fixed at an appropriate position on the front and left side of the sewing bed B by a plurality of set screws. The knife shaft 41 is supported rotatably on its axis by a pair of supporting brackets 40*a* provided on the knife table 40 in positions apart from each other in the shaft direction. The knife shaft 41 is horizontally installed across the front section of the needle plate 3, that is, so as to cross in the direction which is almost orthogonal to the longitudinal direction of the needle plate 3, that is, the feeding direction of the fabric W.

The operational knife 42 has a knife edge portion 42*a* curved in a hook shape at its tip. The proximal part of the operational knife 42 is fixed to one end (left end as seen from the front) of the knife shaft 41 which projects from one side of the one of the supporting brackets 40*a* of the knife table 40. The operational knife 42 swings according to the oscillation of the knife shaft 41 which is performed as will be described hereinlater, and accordingly makes the knife edge portion 42*a* move up-and-down. In the front part of the needle plate 3, a rectangular notched portion 32 is formed with an appropriate width on the left side of the needle-drop holes 30. The knife edge portion 42*a* at the tip of the operational knife 42 which moves vertically projects through the notched portion 32 as shown in FIG. 2 when it moves upward.

As shown in FIG. 3, the stationary knife 43 is a plate-shaped member having the knife edge portion 43*a* at the edge hem of one side in the longitudinal direction. The stationary knife 43 is attached to a fixing table 44 supported by the knife table 40 adjacent to the attaching position of the operational knife 42. As shown in FIG. 2, the stationary knife 43 is disposed so that the knife edge portion 43*a* lies along the vertical edge of the notched portion 32. The knife edge portion 43*a* slidably comes into contact with the knife edge portion 42*a* of the vertically moving operational knife 42 from one side, thereby carrying out the trimming by the slidable contact portion.

As shown in FIG. 3, the fixing table 44 of the stationary knife 43 has a supporting cylinder 44*a* which is projected from one side of the fixing table 44. The supporting cylinder 44*a* is inserted to the supporting bracket 40*a* on the same side of the knife table 40 so as not to rotate. The knife shaft 41 is rotatably fit in the supporting cylinder 44*a*.

Figure 4:
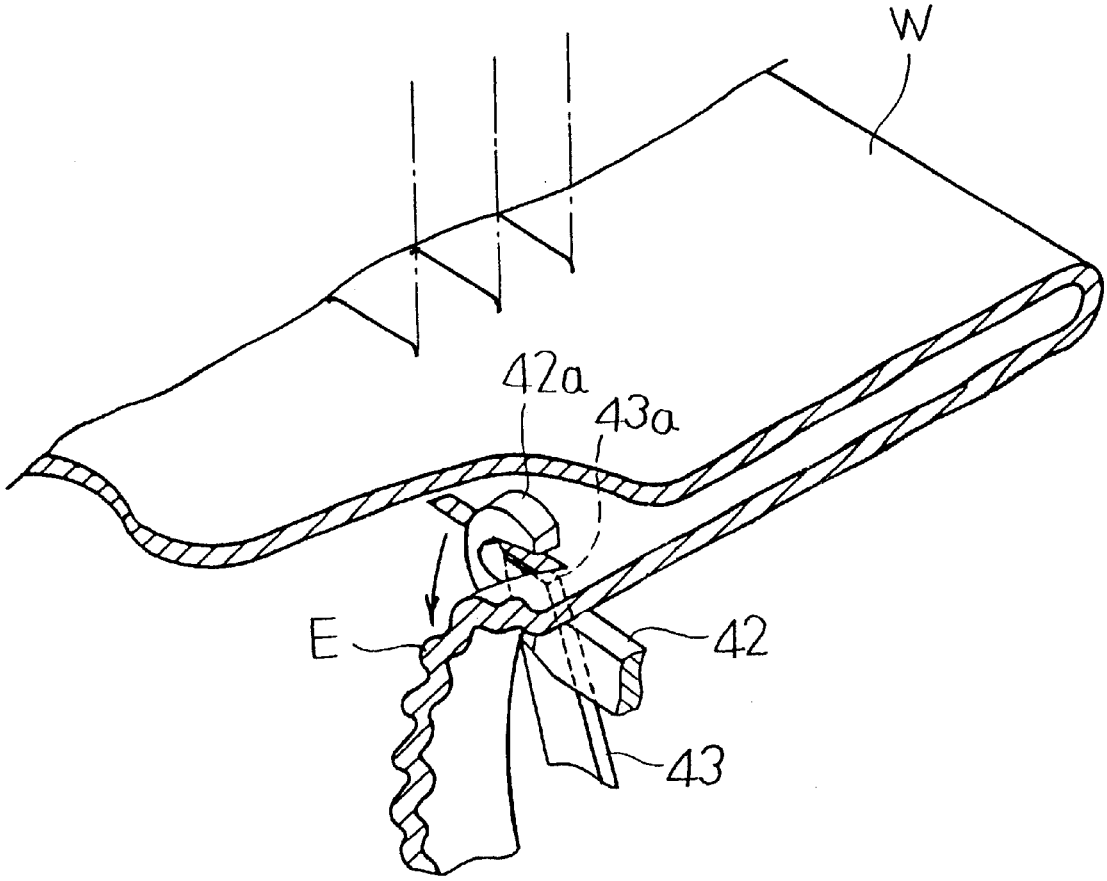
FIG. 4 is a view showing a trimming operation of a fabric by an operational knife and a stationary knife of the trimming mechanism provided to the sewing machine with trimming knives according to the present invention.

FIG. 4 is an explanatory diagram showing a trimming operation of the fabric W by the operational knife 42 and stationary knife 43. The cutting operation is performed on the fabric W which is fed to the needle drop points in a state where the edge hem E is folded back to the back side as shown in the diagram. When the folded portion is hemmed to the surface side of the same fabric W, before the fabric W reaches the needle drop points shown by alternate long and short dash lines in the figure, the trimming operation is performed to trim the fabric W while remaining the folded edge hem E of an appropriate width.

The operational knife 42 which moves up-and-down in the front section of the needle plate 3 pushes the fabric W upward from the rear side when it moves upward, and the knife edge portion 42*a* which is curved in a hook shape captures the folded edge hem E. When the operational knife 42 moves downward in such a state as shown by the arrow in the figure, the edge hem E is moved downward together with the operational knife 42, led to the slidable contact portion of the knife edge portion 42*a* of the operational knife 42 and the knife edge portion 43*a* of the stationary knife 42, and is trimmed. The operational knife 42 is intermittently moved in the vertical direction in short cycles and the folded edge hem E is continuously trimmed.

As shown in FIG. 2, a spring receiving ring 45 is coaxially fixed to the proximal portion of the knife shaft 41 and a stopper ring 47 is also coaxially loosely fit to the proximal portion of the knife shaft 41 so as to face the spring receiving ring 45 with an appropriate distance apart from the spring receiving ring 45. A coil spring 46 is interposed between the spring receiving ring 45 and the stopper ring 47. The knife shaft 41 is pulled toward the proximal end side, that is, to the right side when it is seen from the front by the spring force of the coil spring 46. Consequently, the operational knife 42 attached to the front end side of the knife shaft 41 moves vertically in a state where the knife edge portion 42*a* is pushed to the right side against the knife edge portion 43*a* of the stationary knife 43, so that the cutting operation is excellently performed. The stopper ring 47 is in contact with the end face of the supporting bracket 40*a* on the same side. For example, when a thick fabric W is pressed between the operational knife 42 and the stationary knife 43, the stopper ring 47 regulates the movement toward the left side of the knife shaft 41 which occurs against the spring force of the coil spring 46. The fixing position of the spring receiving ring 45 is adjustable in the axial direction of the knife shaft 41. By adjusting the spring force of the coil spring 46 by the adjustment of the fixing position, the pressing force of the knife edge portions 42*a* and 43*a* can be properly set.

The knife shaft 41 for vertically moving the operational knife 42 is rotate in oscillating fashion by a power transmitted from the machine spindle (not shown) provided across in the sewing bed B. To the knife shaft 41, a transmitting ring 5 and the proximal portion of a transmitting lever 6 are coaxially fit and arranged in the axial direction between the supporting brackets 40*a*.

The transmitting ring 5 is a ring-shaped member fit to the knife shaft 41 so as to be movable in the axial direction and can be fixed to an appropriate position in the direction by fastening the pair of set screws 50. On the other and, the proximal portion of the transmission lever 6 is loosely and rotatably fit to the knife shaft 41. The position in the axial direction is restricted by a spacer ring 60 interposed between the proximal portion and the supporting bracket 40*a* on the same side so as to keep a predetermined distance from the supporting bracket 40*a*.

Figure 5:
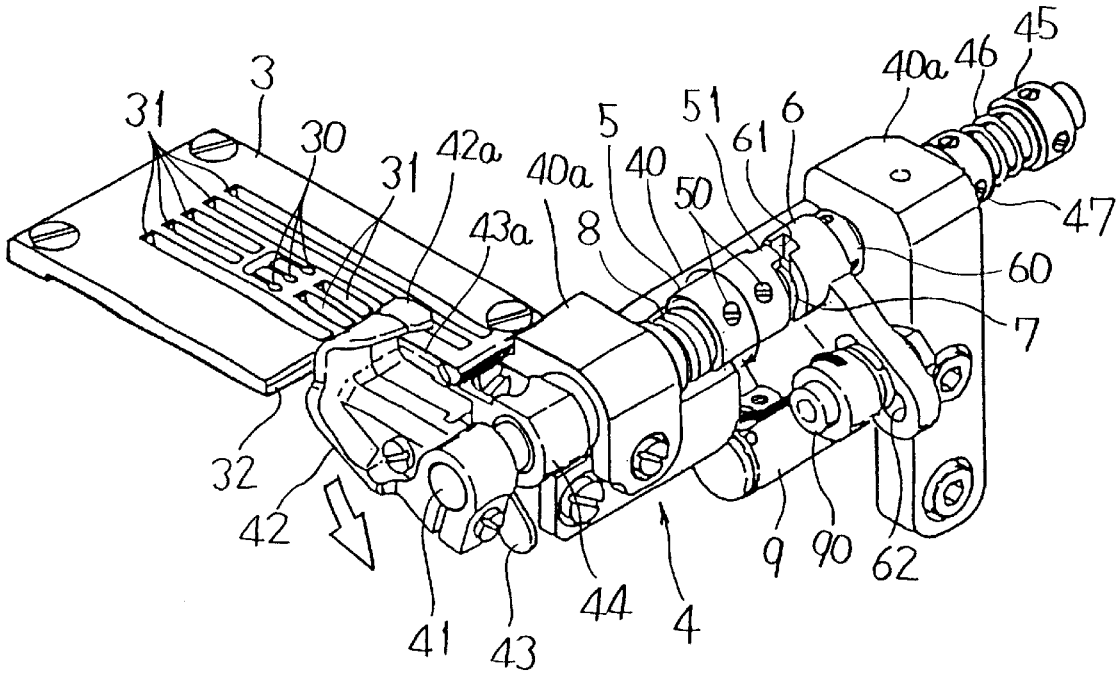
FIG. 5 is a perspective view showing an inoperative state of the trimming mechanism provided to the sewing machine with trimming knives according to the present invention together with the needle plate.

As shown in FIG. 3, a concave portion 61 having a rectangular groove shape is formed so as to be across in the radial direction in the face opposite to the transmitting ring 5 of the proximal portion of the transmitting lever 6. A rectangular convex portion 51 having a shape fit in the concave portion 61 is projected similarly so as to be across in the radial direction of the face opposite to the transmitting lever 6 of the transmitting ring 5. By fixing the transmitting ring 5 to a position close to the transmitting lever 6, the convex portion 51 and the concave portion 61 are engaged with each other as shown in FIG. 2. The engagement is cancelled by fixing the transmitting ring 5 in a position apart from the transmitting lever 6. In such a manner, a claw clutch for connecting the transmitting ring 5 and the transmitting lever 6 is provided. FIG. 5 is a perspective view showing a state where the convex portion 51 and the concave portion 61 are disengaged from each other.

As shown in FIG. 3, a coil spring (first energizing member) 7 fit in the corresponding position of the knife shaft 41 is interposed between the transmitting ring 5 and the transmitting lever 6. The transmitting ring 5 and the transmitting lever 6 are energized in opposite directions by the spring force of the coil spring 7. The transmitting ring 5 released by loosening the set screws 50 is energized by the spring force of the coil spring 7 so as to be apart from the transmitting lever 6, thereby obtaining a disengagement state shown in FIG. 5. Thus, cutting of the transmitting power to the operational knife 42 which will be described hereinlater can be easily and certainly realized.

Further, between the transmitting ring 5 and the supporting bracket 40*a* on the same side, a helical spring (second energizing member) 8 fit in the corresponding position in the knife shaft 41 is interposed. The helical spring 8 is interposed so that both ends of the helical spring 8 which are projected from both sides of the cylindrical portion fit to the knife shaft 41 are fit to an insertion hole 52 formed in an end face of the transmitting ring 5 and an appropriate position in the supporting bracket 40*a*, and energizes the transmitting ring 5 toward one end in the circumferential direction.

When the transmitting ring 5 disengaged with the transmitting lever 6 is rotated forward as shown by the arrow in FIG. 5 and fixed in a state where the helical spring 8 is moved to the same side, the knife shaft 41 after the fixing operation is energized to the opposite direction by the spring force of the helical spring 8. The operational knife 42 attached to the tip of the knife shaft 41 is moved to a downward position as shown by the blank arrow in FIG. 5 and is restricted in the position.

As shown in FIG. 3, a long hole 62 extended in the longitudinal direction is formed at the front end side of the transmitting lever 6. The transmitting lever 6 is coupled to the oscillating shaft (not shown) by a link member 9 connected at some point within the long hole 62 by a tightening bolt 90 as shown in FIG. 2 and FIG. 5. The oscillating shaft is coupled to the machine spindle (not shown) hung across the sewing bed B via a known eccentric mechanism and rotates on its axis in oscillating fashion in accordance with the rotation of the machine spindle. The oscillating motion is transmitted to the transmitting lever 6 via the link member 9. The transmitting lever 6 swings around the knife shaft 41 by which the proximal portion of the transmitting lever 6 is supported. A swing amount of the transmitting lever 6 can be freely adjusted by changing the fixing position of the tightening bolt 90 within the range of the length of the long hole 62.

Since the proximal portion of the transmitting lever 6 is loosely fit to the knife shaft 41, the swing of the transmitting lever 6 which occurs as described above is not transmitted directly to the knife shaft 41. As shown in FIG. 2, when the transmitting ring 5 is fixed so as to be close to the transmitting lever 6 and the convex portion 51 of the transmitting ring 5 and the concave portion 61 of the transmitting lever 6 are engaged wit each other, the swing of the transmitting lever 6 is transmitted to the knife shaft 41 via the transmitting ring 5 to thereby swing the operating cutter 42 attached to the tip of the knife shaft 41. The knife edge portion 42*a* at the tip of the operational knife 42 moves vertically and repeatedly projects from the needle plate 3, so that the folded edge hem E of the fabric W fed onto the needle plate 3 is continuously trimmed and hemmed.

On the other hand, as shown in FIG. 5, when the transmitting ring 5 is fixed apart from the transmitting lever 6 and the convex portion 51 of the transmitting ring 5 and the concave portion 61 of the transmitting lever 6 are disengaged with each other, the swing of the transmitting lever 6 is not transmitted to the knife shaft 41 and the operational knife 42 attached at the tip of the knife shaft 41 does not move vertically. Consequently, regular sewing other than the hemming can be made.

The coil spring 7 is interposed between the transmitting ring 5 and the transmitting lever 6. By the spring force of the coil spring 7, the transmitting ring 5 loosens the set screws 50 and moves apart from the transmitting lever 6 only by an operation of cancellation of the fixing to the knife shaft 41. The interruption of the transmission can be easily and certainly realized.

The transmitting ring 5 is energized in the circumferential direction by the helical spring 8. As described above, by rotating the transmitting ring 5 which is disengaged from the transmitting lever 6 forward and fixing the transmitting ring 5 to the knife shaft 41, the operational knife 42 is moved to the downward position by the spring force of the helical spring 8 and is restricted in the position. The knife shaft 41 is therefore prevented from being swung by an external effect such as frictional force on the loosely fit portion of the transmitting lever 6 which continuously swings also in a regular sewing operation or vibration during a sewing operation, so that the knife edge portion 42*a* of the operational knife 42 does not project from the needle plate 3. There is no possibility that the feeding of the fabric W onto the needle plate is disturbed.

Although an application of the invention to the covering-chain-stitch machine has been described in the foregoing embodiment, obviously, the invention can be also applied to a sewing machine other than the covering-chain-stitch machine. Although the convex portion 51 and the concave 61 portion are formed on the opposing faces of the transmitting ring 5 and the transmitting lever 6 to thereby form the claw clutch by which the secure engagement state can be obtained with a simple configuration, other clutches such as a frictional clutch can be also used.

As this invention may be embodied in several forms without departing from the spirit of essential characteristics thereof, the present embodiment is therefore illustrative and not restrictive, since the scope of the invention is defined by the appended claims rather than by the description preceding them, and all changes that fall within mates and bounds of the claims, or equivalences of such metes and bounds thereof are therefore intended to be embraced by the claims.

What is claimed is:

1. A sewing machine with trimming knives, comprising:

a knife table attached to a sewing bed;

a knife shaft rotatably provided over the knife table;

an operational knife attached to one end of the knife shaft;

a transmitting lever whose one end is loosely fit on the knife shaft halfway in the shaft direction and whose other end is connected via a link member to a oscillating shaft which oscillates on the axis thereof driven by a machine spindle;

a transmitting ring movably fit on the knife shaft in the axial direction and fixed at an appropriate position in the direction;

a clutch, provided on the opposing faces of both the transmitting ring and transmitting lever, and for engaging or disengaging each other according to the transmitting ring approaching to or separating from the other; and a stationary knife being slidably contacted with one side of the operational knife which swings upwardly and downwardly by the rotation of the knife shaft, thereby trimming an edge hem of a fabric being fed onto the sewing bed, when the clutch is engaged.

2. The sewing machine with trimming knives according to claim 1, wherein the clutch is a claw clutch which achieves an engagement state by engaging a concave portion provided on either one of the transmitting ring or transmitting lever and a convex portion provided on the other.

3. The sewing machine with trimming knives according to claim 1, further comprising:

a first energizing member, interposed between the transmitting ring and transmitting lever, for energizing the transmitting ring and transmitting lever in the separating direction from each other.

4. The sewing machine with trimming knives according to claim 1, further comprising:

a second energizing member, interposed between the transmitting ring and knife table, for energizing the transmitting ring in the circumferential direction to restrict the operational knife in a downward movement position via the transmitting ring and knife shaft when the clutch is disengaged.

5. The sewing machine with trimming knives according to claim 2, further comprising:

a first energizing member, interposed between the transmitting ring and transmitting lever, for energizing the transmitting ring and transmitting lever in the separating direction from each other.

6. The sewing machine with trimming knives according to claim 2, further comprising:

a second energizing member, interposed between the transmitting ring and knife table, for energizing the transmitting ring in the circumferential direction to restrict the operational knife in a downward movement position via the transmitting ring and knife shaft when the clutch is disengaged.

7. The sewing machine with trimming knives according to claim 3, further comprising:

a first energizing member, interposed between the transmitting ring and transmitting lever, for energizing the transmitting ring and transmitting lever in the separating direction from each other.

* * * * *